US006640755B2

(12) United States Patent
Araki

(10) Patent No.: US 6,640,755 B2
(45) Date of Patent: Nov. 4, 2003

(54) TWO-CYCLE INTERNAL COMBUSTION ENGINE

(75) Inventor: Tsuneo Araki, Tokyo (JP)

(73) Assignee: Kioritz Corporation, Tokyo (JP)

( * ) Notice: Subject to any disclaimer, the term of this patent is extended or adjusted under 35 U.S.C. 154(b) by 0 days.

(21) Appl. No.: 10/066,043

(22) Filed: Jan. 31, 2002

(65) Prior Publication Data

US 2002/0139326 A1 Oct. 3, 2002

(30) Foreign Application Priority Data

Feb. 1, 2001 (JP) ..... 2001-026100

(51) Int. Cl.[7] ..... F02B 25/16; F02F 1/22
(52) U.S. Cl. ..... 123/73 PP; 123/65 P
(58) Field of Search ..... 123/73 PP, 65 P, 123/75 V

(56) References Cited

U.S. PATENT DOCUMENTS

| | | | | |
|---|---|---|---|---|
| 5,251,580 A | * | 10/1993 | Torigai | 123/73 PP |
| 5,857,450 A | * | 1/1999 | Staerzl | 123/73 PP |
| 5,870,981 A | * | 2/1999 | Knaus et al. | 123/73 PP |
| 6,216,650 B1 | * | 4/2001 | Noguchi | 123/73 PP |
| 6,257,179 B1 | * | 7/2001 | Uenoyama et al. | 123/73 PP |
| 6,273,037 B1 | * | 8/2001 | Cobb, Jr. | 123/73 PP |
| 6,289,856 B1 | * | 9/2001 | Noguchi | 123/73 PP |
| 6,460,494 B1 | * | 10/2002 | Cobb, Jr. | 123/73 PP |

OTHER PUBLICATIONS

Japanese Patent Laid–Open Publication [Kokai] No. 5–33657 (1993)—English–language Abstract attached.
Japanese Patent Laid–Open Publication [Kokai] No. 9–125966 (1997)—English–language Abstract attached.
Japanese Patent Laid–Open Publication [Kokai] No. 2000–136725)—English–language Abstract attached.

* cited by examiner

*Primary Examiner*—Henry C. Yuen
*Assistant Examiner*—Jason Benton
(74) *Attorney, Agent, or Firm*—Baker Botts LLP

(57) ABSTRACT

A two-cycle internal combustion engine which is capable of inhibiting air-fuel mixture from being mixed with the air introduced in advance into the combustion actuating chamber during the scavenging period, thereby realizing a complete lamellar scavenging. This engine is constructed such that one or more pairs of Schnürle type scavenging passageways (31, 32), each allowing the combustion actuating chamber (15) disposed above a piston (20) placed in a cylinder (10) to be communicated with the crank chamber (18), are symmetrically provided on both sides of a longitudinal section (F—F) which imaginatively divides an exhaust port (34) into two equal parts, thereby enabling air (A) to be introduced into the scavenging passageways (31, 32) and also enabling an air-fuel mixture (M) to be introduced into the crank chamber (18); and that in the descending stroke of the piston (20), the exhaust port (34) is opened at first, and then, the scavenging port which is disposed at a downstream end of the scavenging passageway is opened, thereby enabling air (A) to be introduced via the scavenging passageway into the combustion actuating chamber (15) prior to the introduction of air-fuel mixture (M) into the combustion actuating chamber (15); said internal combustion engine being characterized in that said one or more pairs of Schnürle type scavenging passageways (31, 32) are respectively provided, near the end portion thereof located close to the crank chamber (18), with a throttled portion (31*e*, 32*e*).

15 Claims, 8 Drawing Sheets

TWO-CYCLE INTERNAL COMBUSTION ENGINE

BACKGROUND OF THE INVENTION

The present invention relates to a two-cycle internal combustion engine which is suited for use in a portable power working machine, and in particular to a two-cycle internal combustion engine which is designed to introduce air into a combustion actuating chamber (though it may be also called combustion chamber, actuating chamber, cylinder chamber, etc., these chambers are generically referred to as combustion actuating chamber in the present specification) prior to the introduction of air-fuel mixture, thereby making it possible to minimize the quantity of so-called blow-by or the quantity of air-fuel mixture to be discharged without being utilized for the combustion.

An ordinary two-cycle gasoline engine which is conventionally used in a portable power working machine such as a chain saw and brush cutter is constructed such that an ignition plug is disposed at a head portion of a cylinder, and an intake port, a scavenging port and an exhaust port, which are to be opened and closed by a piston, are provided at the trunk portion of the cylinder. According to this two-cycle internal combustion engine, one cycle of engine is accomplished by two strokes of the piston without undergoing a stroke which is exclusively assigned to the intake or exhaust.

More specifically, in the ascending stroke of the piston, air-fuel mixture is introduced from the intake port into the crankcase disposed below the piston. When the piston is turned into a descending stroke, the air-fuel mixture is pre-compressed producing a compressed gas mixture, which is then blown into a combustion actuating chamber which is disposed above the piston, thereby enabling waste combustion gas to be discharged from the exhaust port. In other words, since the scavenging of the waste combustion gas is effected by making use of the gas flow of the air-fuel mixture, the unburnt air-fuel mixture is more likely to be mixed into the combustion waste gas (exhaust gas), thereby increasing the quantity of so-called blow-by or the quantity of air-fuel mixture to be discharged into air atmosphere without being utilized for the combustion. Because of this, the two-cycle internal combustion engine is not only inferior in fuel consumption but also disadvantageous in that a large amount of poisonous components such as HC (unburnt components in a fuel) and CO (incomplete combustion components in a fuel) are caused to be included into the exhaust gas as compared with a four-stroke engine. Therefore, even if the two-cycle engine is small in capacity, the influence of these poisonous components on the environmental contamination would not be disregarded.

With a view to cope with these problems, there have proposed various kinds of so-called air-preintroduction (lamellar scavenging) type two-cycle internal combustion engine, which are featured in that an air inlet passageway for introducing external air is attached to a scavenging passageway, thereby permitting air to be introduced into the combustion actuating chamber in the descending stroke of piston prior to the introduction of air-fuel mixture, the air thus pre-introduced functioning to form air layer between waste combustion gas to be discharged and unburnt air-fuel mixture to thereby prevent the unburnt air-fuel mixture from being mixed with the waste combustion gas, thus minimizing the quantity of blow-by of air-fuel mixture (for example, Japanese Patent Unexamined Publications H9-125966 and H5-33657, and Japanese Patent No. 3040758).

The present inventors have also already proposed an air-preintroduction type two-cycle internal combustion engine having a basic structure as explained below. (Japanese Patent Application 2000-318841).

Namely, this previously proposed two-stroke internal combustion engine which is featured in that one or more pairs of Schnürle type scavenging passageways, each allowing the combustion actuating chamber disposed above the piston inside the cylinder to be communicated with the crank chamber, are symmetrically provided on both sides of the longitudinal section which imaginatively divides an exhaust port into two equal parts, thereby enabling air to be introduced into the scavenging passageways and also enabling an air-fuel mixture to be introduced into the crank chamber; and that in the descending stroke of the piston, the exhaust port is opened at first, and then, the scavenging port which is disposed at a downstream end of the scavenging passageway is opened, thereby enabling air to be introduced via the scavenging passageway into the combustion actuating chamber prior to the introduction of air-fuel mixture.

According to this two-stroke internal combustion engine proposed previously by the present inventors, an external air is sucked up and stored in the scavenging passageways and in the crank chamber through an air inlet passageway and an air check valve disposed in the air inlet passageway in the ascending stroke of piston, and at the same time, the air-fuel mixture supplied from an air-fuel mixture-generating means such as a carburetor is sucked up and stored in the crank chamber through an air-fuel mixture supply passageway and an air-fuel mixture inlet port.

When the air-fuel mixture inside the combustion actuating chamber disposed above the piston is exploded and burnt through the ignition thereof, the piston is pushed downward due to the combustion gas. In this descending stroke of the piston, the air as well as the air-fuel mixture existing inside the scavenging passageways and the crank chamber are compressed by the piston, and at the same time, the exhaust port is opened at first, and as the piston is further descended, the scavenging port provided at a downstream end of each of the scavenging passageways is opened. During this scavenging period where the scavenging port is kept opened, only the air that has been compressed by the piston and stored inside the scavenging passageways is permitted to be introduced from the scavenging port into the combustion actuating chamber.

Subsequently, when the piston is further descended, the introduction of air from the scavenging port into the combustion actuating chamber is accomplished, and then, the air-fuel mixture that has been pre-compressed in the crank chamber is permitted to be introduced, via the scavenging passageways, into the combustion actuating chamber until the scavenging period is finished.

Therefore, since air is introduced from the scavenging port into the combustion actuating chamber prior to the introduction of air-fuel mixture into the combustion actuating chamber in the descending stroke of the piston, the waste combustion gas is forced, due to this air, to go out of the exhaust port and scavenged therethrough, so that almost all of the combustion is not permitted to remain inside the combustion actuating chamber or any other portions including the region located close to the inner wall portion of cylinder which is located opposite to the exhaust port. Thereafter, the waste combustion gas is discharged through a muffler into the external atmosphere.

In this case, since a layer of the air that has been introduced in advance into the combustion actuating chamber through the scavenging port is permitted to be formed between the waste combustion gas and the air-fuel mixture that has been introduced belatedly into the combustion actuating chamber through the scavenging port, the air-fuel mixture can be effectively prevented from being mixed with the waste combustion gas due to this air layer. As a result, it is possible to realize a lamellar scavenging and to minimize the quantity of so-called blow-by, i.e. the quantity of air-fuel mixture to be discharged without being utilized for the combustion, thus making it possible to realize a reliable and perfect ignition of air-fuel mixture, to improve the fuel consumption, and to minimize the content of poisonous components in the exhaust gas.

However, according to this air-preintroduction (lamellar scavenging) type two-cycle internal combustion engine which has been previously proposed by the present inventors, since the effective cross-sectional passage area at the end portion of the scavenging passageway (upstream end=scavenging inlet port) which is located close to the crank chamber is generally almost equal to or larger than the downstream portion of the scavenging passageway, the air-fuel mixture introduced into the combustion actuating chamber is enabled to easily mix with the air that has been introduced in advance into the combustion actuating chamber during the scavenging period (especially, during the intermediate period through the last period thereof), thereby giving rise to the generation of incomplete lamellar scavenging.

The present invention has been made to overcome the aforementioned problems, and therefore an object of the present invention is to provide an air-preintroduction type two-cycle internal combustion engine which is capable of minimizing the possibility of air-fuel mixture being mixed with the air that has been introduced in advance into the combustion actuating chamber during the scavenging period, thereby enabling a complete lamellar scavenging to be performed.

BRIEF SUMMARY OF THE INVENTION

With a view to realize the aforementioned objects, the two-cycle internal combustion engine according to the present invention is basically constructed such that one or more pairs of Schnürle type scavenging passageways, each allowing the combustion actuating chamber disposed above a piston placed in a cylinder to be communicated with a crank chamber, are symmetrically provided on both sides of the longitudinal section which imaginatively divides an exhaust port into two equal parts, thereby enabling air to be introduced into the scavenging passageways and also enabling air-fuel mixture to be introduced into the crank chamber; and that in the descending stroke of the piston, the exhaust port is opened at first, and then, the scavenging port which is disposed at a downstream end of the scavenging passageway is opened, thereby enabling air to be introduced via the scavenging passageway into the combustion actuating chamber prior to the introduction of air-fuel mixture into the combustion actuating chamber.

This two-cycle internal combustion engine is characterized in that said one or more pairs of Schnürle type scavenging passageways are respectively provided, near the end portion thereof located close to the crank chamber, with a throttled portion.

In a preferred embodiment, the paired scavenging passageways are combined with each other at the portion thereof located close to the crank chamber to thereby enlarge the volume thereof, and are communicated with the crank chamber via a common throttled portion for reducing the effective cross-sectional passage area to such an extent that it becomes smaller than that of the downstream portion of the scavenging passageway.

In another preferred embodiment, the scavenging passageways are provided respectively with an air inlet passageway for introducing air therein, and the air inlet passageway is provided with an air check valve.

In this case, the volume of the scavenging passageways is preferably set to such that it is equal to or slightly smaller than the quantity of air to be introduced in advance.

The effective cross-sectional passage area of the throttled portion is preferably set to such that a required quantity of air-fuel mixture can be fed to the combustion actuating chamber following the introduction of air thereto.

According to the preferable embodiments of two-cycle internal combustion engine of the present invention, which are constructed as described above, when the crank chamber is turned into a negative pressure in the ascending stroke of the piston, the external air is permitted to be sucked and stored in the air inlet passageway and in the scavenging passageways (the air may be introduced more or less into the crank chamber through the throttled portion), and at the same time, air-fuel mixture to be fed from the air-fuel mixture-generating means such as a carburetor is sucked up and stored in the crank chamber through an air-fuel mixture supply passageway and an air-fuel mixture inlet port.

When the air-fuel mixture inside the combustion actuating chamber disposed above the piston is exploded and burnt through the ignition thereof, the piston is pushed downward due to the combustion gas. In this descending stroke of the piston, the air as well as the air-fuel mixture existing inside the air inlet passageway, the scavenging passageways and the crank chamber are compressed by the piston, and at the same time, the exhaust port is opened at first, and as the piston is further descended, the scavenging port provided at a downstream end of each of the scavenging passageways is opened. During this scavenging period where the scavenging port is kept opened, only the air that has been compressed by the piston and stored inside the scavenging passageways is permitted to be introduced from the scavenging port into the combustion actuating chamber.

Subsequently, when the piston is further descended, the introduction of air from the scavenging port into the combustion actuating chamber is accomplished, and then, the air-fuel mixture that has been pre-compressed in the crank chamber is permitted to be introduced, via the scavenging passageways provided with the throttled portion, into the combustion actuating chamber until the scavenging period is finished.

Therefore, since air is introduced from the scavenging port into the combustion actuating chamber prior to the introduction of air-fuel mixture into the combustion actuating chamber in the descending stroke of the piston, the combustion exhaust gas is forced, due to this air, to go out of the exhaust port and scavenged therethrough, so that almost all of the combustion is not permitted to remain inside the combustion actuating chamber or any other portions including the region located close to the inner wall portion of cylinder which is located opposite to the exhaust port. Thereafter, the combustion exhaust gas is discharged through a muffler into the external atmosphere.

In this case, since a layer of the air that has been introduced in advance into the combustion actuating chamber through the scavenging port is permitted to be formed between the combustion exhaust gas and the air-fuel mixture that has been introduced belatedly into the combustion actuating chamber through the scavenging port, the air-fuel mixture can be effectively prevented from being mixed with the combustion exhaust gas due to this air layer. As a result, it is possible to realize a lamellar scavenging and to minimize the quantity of so-called blow-by, i.e. the quantity of air-fuel mixture to be discharged without being utilized for the combustion, thus making it possible to realize a reliable and perfect ignition of air-fuel mixture, to improve the fuel consumption, and to minimize the content of poisonous components in the exhaust gas.

Furthermore, according to the two-cycle internal combustion engine of the present invention, since a throttled portion is provided at the end portion of the scavenging passageway (upstream end=scavenging inlet port) which is located close to the crank chamber, air-fuel mixture can be hardly mixed with the air that has been sucked in advance into the scavenging passageway. As a result, the pre-introduction of air can be reliably performed, thereby making it possible to realize a more perfect lamellar scavenging.

Additionally, due to the provision of the throttled portion, air-fuel mixture can be introduced into the scavenging passageways from the crank chamber only when the pressure inside the crank chamber is increased to a certain magnitude. In other words, since the timing of introducing air-fuel mixture into the scavenging passageways from the crank chamber is slightly delayed as compared with the case where the aforementioned throttled portion is not provided, it becomes possible to realize a more perfect lamellar scavenging.

As a result, it is now possible to perform a more perfect lamellar scavenging and to minimize the quantity of so-called blow-by, i.e. the quantity of air-fuel mixture to be discharged without being utilized for the combustion, thus making it possible to realize a reliable and perfect ignition of air-fuel mixture, to improve the fuel consumption, and to minimize the content of poisonous components in the exhaust gas.

DETAILED DESCRIPTION OF THE INVENTION

Next, various embodiments of the two-cycle internal combustion engine according to the present invention will be explained with reference to the drawings.

Figure 1:
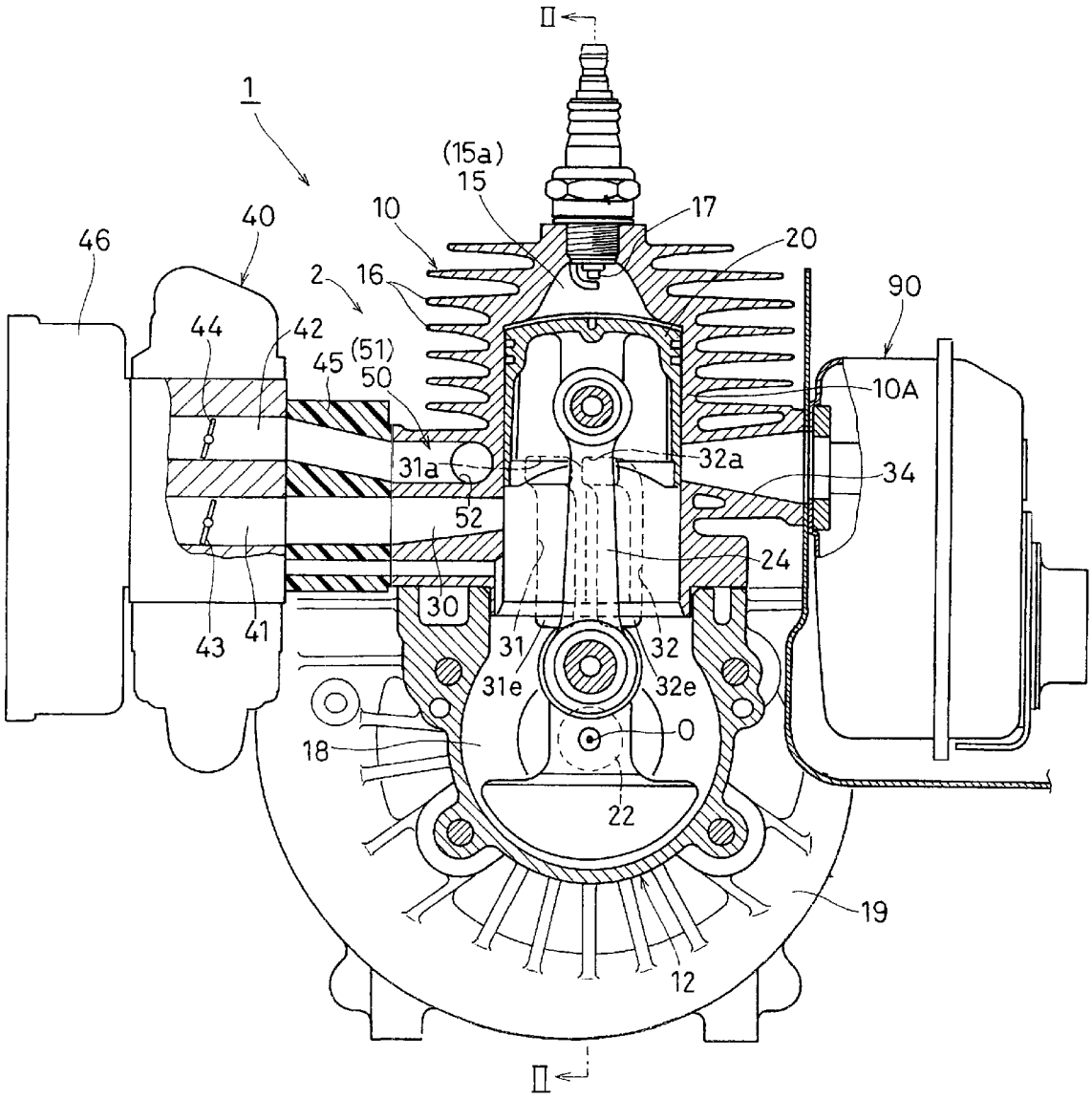
FIG. 1 is a longitudinal sectional view illustrating a first embodiment of a two-cycle internal combustion engine according to the present invention, wherein the piston is positioned at the top dead center.
Figure 2:
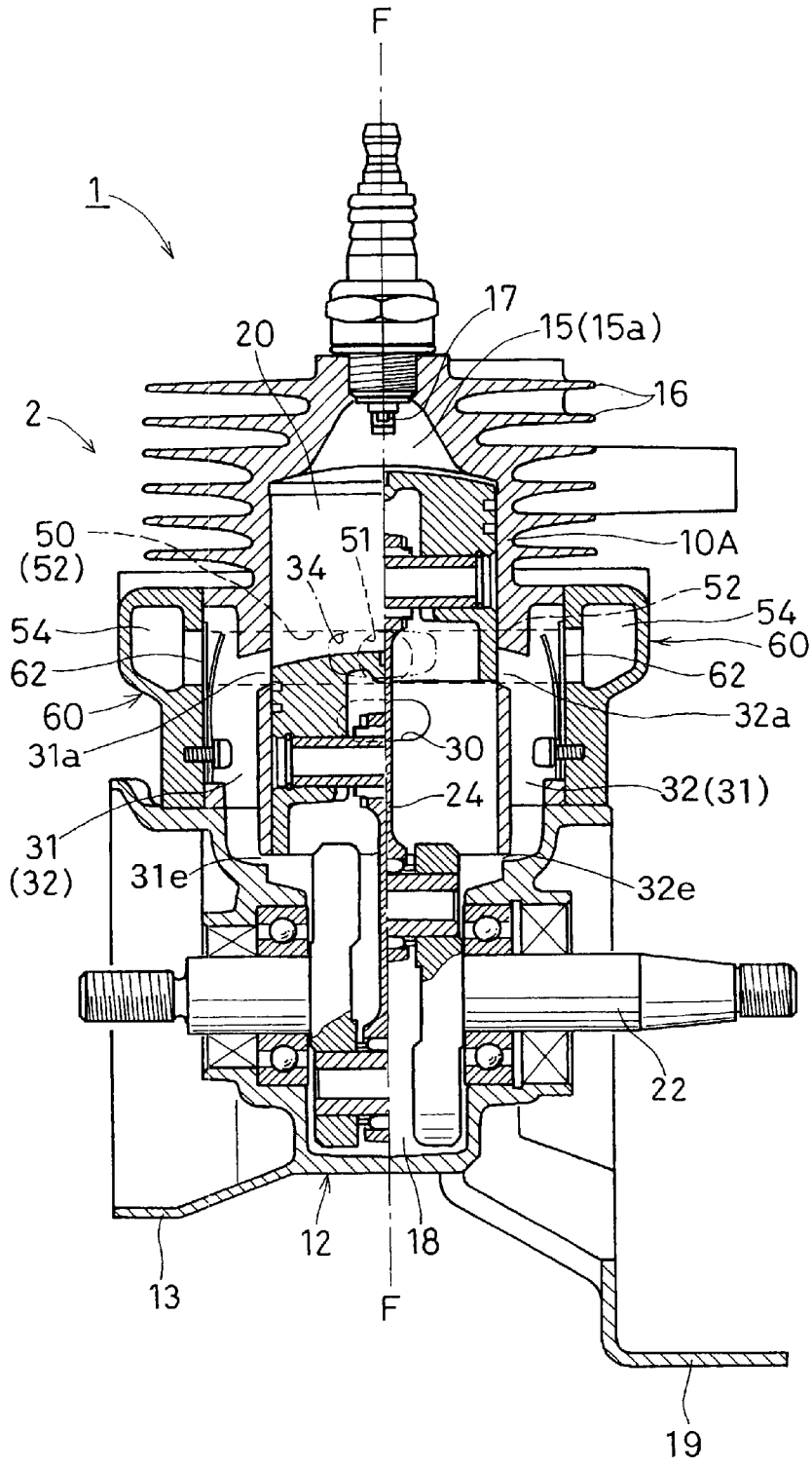
FIG. 2 is a cross-sectional view taken along the line II—II in FIG. 1.
Figure 3:
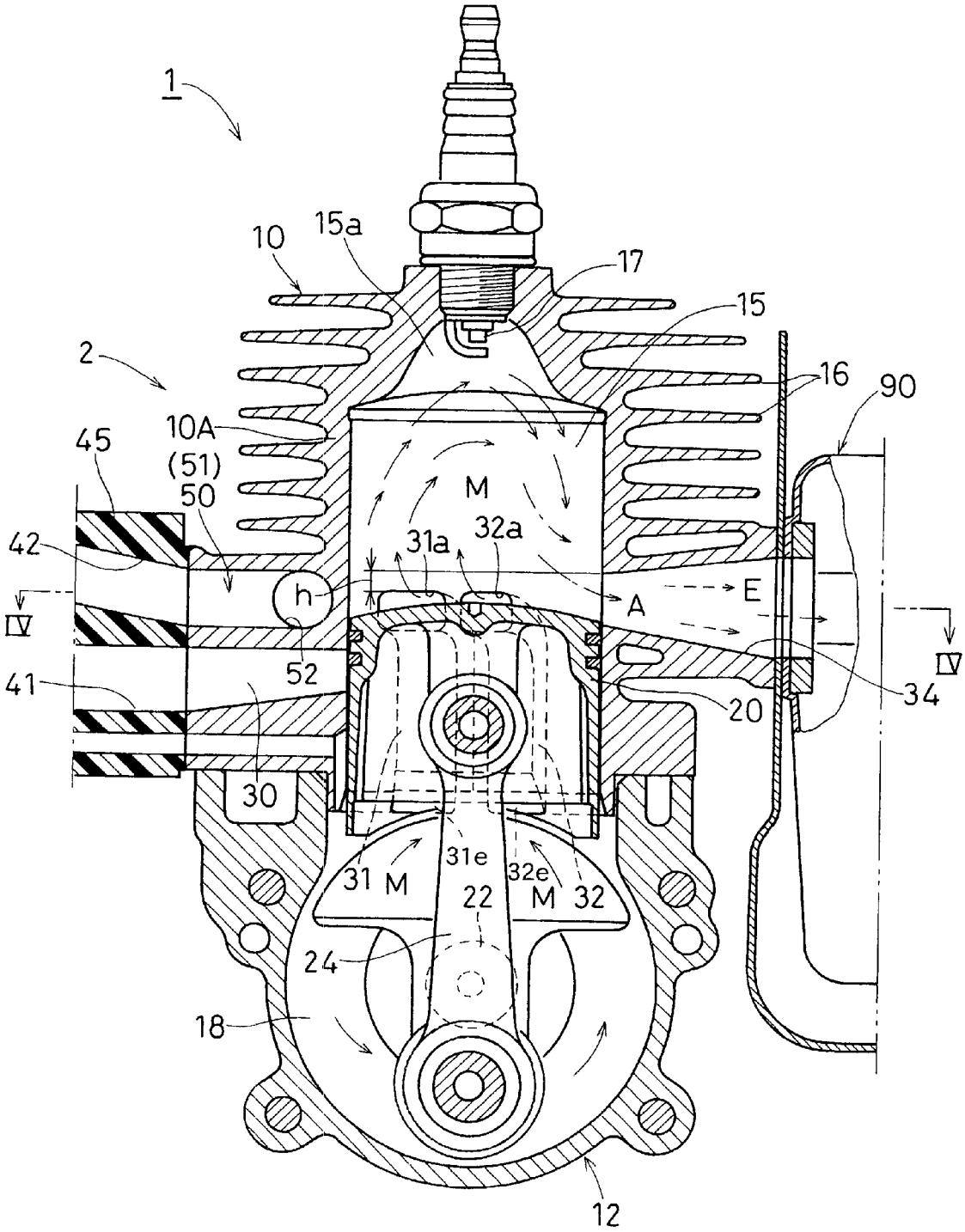
FIG. 3 is an enlarged longitudinal sectional view corresponding to that shown in FIG. 1, wherein the piston is positioned at the bottom dead center.
Figure 4:
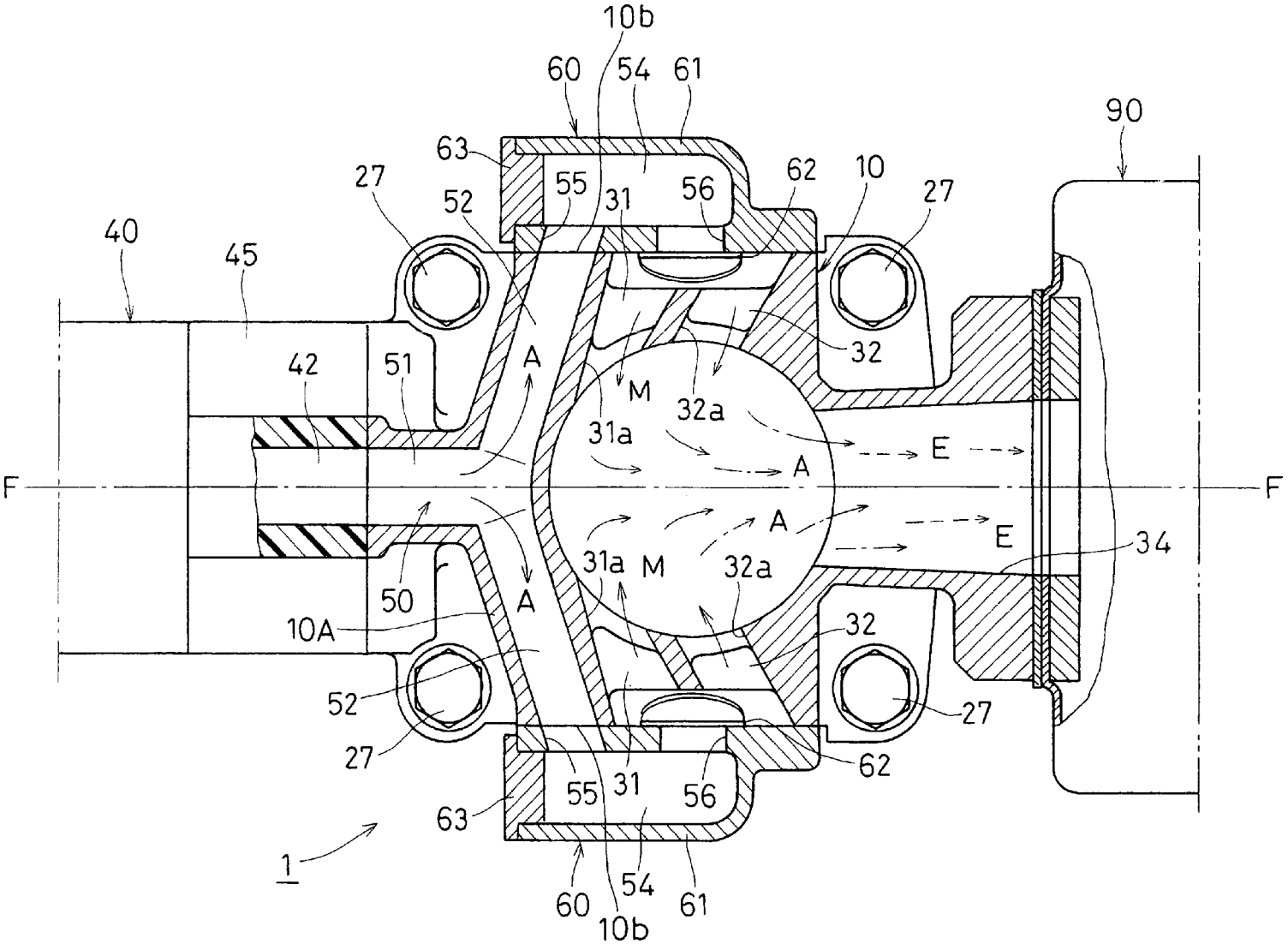
FIG. 4 is a cross-sectional view taken along the line IV—IV in FIG. 3.

FIG. 1 is a longitudinal sectional view illustrating a first embodiment of a two-cycle internal combustion engine according to the present invention, wherein a piston is positioned at the top dead center; FIG. 2 is a cross-sectional view taken along the line II—II in FIG. 1; FIG. 3 is an enlarged longitudinal sectional view corresponding to that shown in FIG. 1, wherein the piston is positioned at the bottom dead center; and FIG. 4 is a cross-sectional view taken along the line IV—IV in FIG. 3.

For the convenience of explanation, the left side of the line F—F in FIG. 2 illustrates a longitudinal sectional view sectioning a first scavenging port where the piston is positioned at the bottom dead center, while the right side thereof illustrates a longitudinal sectional view sectioning a second scavenging port where the piston is positioned at the top dead center.

Referring to these FIGS., the two-cycle internal combustion engine 1 is formed of a small air-cooled two-cycle gasoline engine of quaternary scavenging type, which is adapted to be employed in a portable working machine. This engine 1 comprises a cylinder 10 in which a piston 20 is fittingly inserted, and a crankcase 12 of vertically split structure which is disposed below the cylinder 10 and hermetically fastened by means of four through-bolts 27 which are inserted respectively at four corners of these components (see FIG. 4). The crankcase 12 defines a crank chamber 18 located below the cylinder 10 and rotatably support a crank shaft 22 which is designed to reciprocatively move the piston 20 up and down through a con'rod 24. The main body 2 of the engine 1 is constituted by the cylinder 10 and the crankcase 12.

On the right side and left side of the crankcase 12 are integrally disposed the base body 13 of the recoil starter case and the base body 19 of the fan casing, respectively.

The cylinder 10 is provided, on the outer circumferential wall thereof, with a large number of cooling fins 16, and, at the head portion thereof, with a squish-dome shape (semi-spherical) combustion chamber 15*a* constituting the combustion actuating chamber 15. An ignition plug 17 is protruded into the combustion chamber 15*a*.

An exhaust port 34 is attached to one side (the right side in FIG. 1) of trunk portion of the cylinder 10. A pair of first scavenging passages 31 of Schnürle type (which are located on a side opposite to where the exhaust port 34 is disposed) and another pair of second scavenging passages 32 of Schn ürle type (which are located on a side close to the exhaust port 34) are symmetrically provided on both sides of the longitudinal section F—F (FIG. 2) which imaginatively divides the exhaust port 34, in widthwise, into two equal parts. Further, a pair of first scavenging ports 31*a* and another pair of second scavenging ports 32*a*, both opened to the combustion actuating chamber 15, are disposed at upper ends (downstream ends) of these first scavenging passages 31 and second scavenging passages 32.

In this embodiment, the top level of the first scavenging ports 31*a* is made identical with the top level of the second scavenging ports 32*a*, and these top levels are positioned lower than the top end of the exhaust port 34 by a distance of "h" (see FIG. 3). As a result, in the descending stroke of the piston 20, both of the first scavenging ports 31*a* and the second scavenging ports 32*a* are permitted to simultaneously open a moment later than the exhaust port 34. By the way, the external peripheral sides of these first and second scavenging passages 31 and 32 are closed by a pair of right and left cap members 60 which are attached to the flat portions 10*b* of the cylinder 10 which have been worked flush with the outer periphery of the wall 10A of the cylinder 10 (see FIG. 4).

According to this embodiment, an air inlet passageway 50 for introducing air "A" into these two pairs of the first and second scavenging passages 31 and 32 is provided in a portion of the wall 10A of the cylinder 10, which is located opposite to where the exhaust port 34 is located (left side in FIG. 1).

This air inlet passageway 50 is composed of an air intake port 51 disposed close to the center (in the elevational direction) of the cylinder 10, a pair of linear branch passageways 52 which are communicated, at a predetermined intersecting angle, with the air intake port 51, and a pair of intercommunicating portions 54 for enabling the branch passageways 52 to communicate with the first and second scavenging passages 31 and 32.

This pair of intercommunicating portions 54 are formed by means of the cap members 60 which are attached to the cylinder 10. The cap members 60 are respectively constituted by a passage-forming portion 61 which is U-shaped in cross-section and 9-shaped in longitudinal section, and a blind cap member 63 for closing the opening of the passage-forming portion 61. The passage-forming portion 61 is provided with air inlet port 55 facing the branch passageway 52, with an air outlet port 56 facing the scavenging passages 31 and 32, and with a stopper-attached air reed valve 62 which is disposed close to the air outlet port 56 and in a manner to face the scavenging passages 31 and 32, this air reed valve 62 functioning as an air check valve for opening and closing the air outlet port 56.

On the other hand, the cylinder 10 is provided, at a portion thereof below the air intake port 51, with an air-fuel mixture intake port 30 to be opened and closed by the piston 15. A carburetor 40 functioning as air-fuel mixture-forming means is attached through a passageway-attached heat insulator 45 to the air intake port 50 and the air-fuel mixture intake port 30. On the upstream side of the carburetor 40 is mounted an air cleaner 46.

It is designed that air "A" and air-fuel mixture "M" are introduced, via the air cleaner 46, the carburetor 40 and the insulator 45, into the air intake port 51 and the air-fuel mixture intake port 30, respectively.

The carburetor 40 is provided with an air feeding passageway 42 for guiding the external air "A" that has been cleaned by the air cleaner 46 to the air intake port 51, and with an air-fuel mixture feeding passageway 41 for guiding air-fuel mixture "M" that has been produced in the carburetor 40 to the crank chamber 18 through the insulator 45 and the air-fuel mixture intake port 30. These air feeding passageway 42 and air-fuel mixture feeding passageway 41 are provided with throttle valves 44 and 43, respectively, which are designed to be interlocked with each other through a link member (not shown).

As shown in FIG. 2, the two-cycle internal combustion engine 1 of this embodiment is further provided, in addition to the aforementioned structure, with throttled portions 31*e* and 32*e* which are formed in the first scavenging passages 31 and the second scavenging passages 32, and are located close to the end portion of the crank chamber 18 (upstream end=scavenging inlet port).

In this embodiment, the volumes of the first scavenging passages 31 and the second scavenging passages 32 are made almost equal to each other, and are set to such a size which enable the external air "A" to be filled therein, and at the same time, a small portion of the external air "A" is also allowed to enter into the crank chamber 18. In other words, the volumes of the first scavenging passages 31 and the second scavenging passages 32 are set to such that they are equal to or slightly smaller than the quantity of the air to be introduced in advance into the combustion actuating chamber 15.

The throttled portions 31*e* and 32*e* are provided in such a manner that the effective cross-sectional passage area thereof is smaller than that of the downstream portion of each of the first and second scavenging passages 31 and 32. Further, the effective cross-sectional passage area of these first and second scavenging passages 31 and 32 is substantially equal to each other. Additionally, the size of the effective cross-sectional passage area of these first and second scavenging passages 31 and 32 is set to such that a required quantity of air-fuel mixture (M) (a quantity to achieve a predetermined air-fuel ratio) can be fed to the combustion actuating chamber (15) following the introduction of air (A) thereto.

According to the two-cycle internal combustion engine 1 of this embodiment which is constructed as described above, the external air "A" is sucked up and introduced through the air feeding passageway 42, the air inlet passageway 50 and the air reed valve 62 into the first and second scavenging passages 31 and 32, and stored therein (a small quantity of the air "A" is also introduced into the crank chamber 18 through the throttled portions 31*e* and 32*e*). On the other hand, the air-fuel mixture "M" supplied from the carburetor 40 is sucked up and introduced through the air-fuel mixture feeding passageway 41 and the air-fuel mixture intake port 30 into the crank chamber 18, allowing the air-fuel mixture to be stored therein (see FIGS. 1 and 2). On this occasion, the first and second scavenging passages 31 and 32 are filled only with the air "A", and the air-fuel mixture "M" is prevented from entering into these scavenging passages 31 and 32.

When the air-fuel mixture "M" compressed by the ascending movement of the piston 20 and existing inside the combustion actuating chamber 15 is ignited and exploded, the piston 20 is pushed down due a combustion gas. During this descending stroke of the piston 20, the air "A" and the air-fuel mixture "M" existing in the first and second scavenging passages 31 and 32, and in the crank chamber 18 are compressed by the piston 20, and at the same time, an exhaust port 34 is opened at first, and when the piston 20 is further descended by a predetermined distance "h", the first and second scavenging ports 31*a* and 32*a* provided at a downstream end of the first and second scavenging passageways 31 and 32 are opened. During this scavenging period wherein the scavenging ports 31*a* and 32*a* are opened, only the air "A" which has been existed in the first and second scavenging passageways 31 and 32 and compressed by the descending stroke of the piston 20 is permitted to be introduced in advance into the combustion actuating chamber 15 from the scavenging ports 31*a* and 32*a*.

When the piston 20 is further descended, the introduction of air "A" from the scavenging ports 31*a* and 32*a* to the combustion actuating chamber 15 is completed, after which, following the air "A", the air-fuel mixture "M" that has been precompressed in the crank chamber 18 is introduced via the first and second scavenging passageways 31 and 32 into the combustion actuating chamber 15 until the scavenging period is completed.

Therefore, since air "A" is introduced in advance into the combustion actuating chamber 15 from the scavenging ports 31*a* and 32*a* prior to the introduction of air-fuel mixture "M" in the descending stroke of the piston, the waste combustion gas "E" is forced, by this action of air "A", to be pushed out of the exhaust port 34 and then, discharged via a muffler 90 into the external atmosphere without leaving a residue of waste combustion gas "E" not only in the combustion actuating chamber 15 but also in a portion near the inner wall of cylinder which is disposed opposite to the exhaust port 34.

In this case, a layer of the air "A" that has been introduced in advance from the scavenging ports 31*a* and 32*a* into the combustion actuating chamber 15 is formed at an interface between the waste combustion gas "E" and the air-fuel mixture "M" that has been introduced, subsequent to the air "A", from the scavenging ports 31*a* and 32*a* into the combustion actuating chamber 15. Due to the existence of this air layer, the air-fuel mixture "M" is effectively prevented from being mixed with the waste combustion gas "E", thereby realizing almost a complete lamellar scavenging. As a result, the quantity of so-called blow-by or the quantity of air-fuel mixture "M" to be discharged without being utilized for the combustion can be reduced to as minimum as possible, thus making it possible to reliably and completely ignite the air-fuel mixture "M", to improve the fuel consumption and to reduce the content of poisonous components in the exhaust gas.

In particular, according to the two-cycle internal combustion engine 1 of this embodiment, since the throttled portions 31*e* and 32*e* are provided at the end portion of the scavenging passageways 31 and 32 (upstream end) which is located close to the crank chamber 18, an air-fuel mixture "M" can be inhibited from being mixed with the air "A" that has been sucked in advance into the scavenging passageways 31 and 32. As a result, the pre-introduction of air "A" can be reliably performed, thereby making it possible to realize a more perfect lamellar scavenging.

Additionally, due to the provision of the throttled portions 31*e* and 32*e,* the air-fuel mixture "M" can be introduced into the scavenging passageways 31 and 32 from the crank chamber 18 only when the pressure inside the crank chamber 18 is increased to a certain magnitude. In other words, since the timing of introducing an air-fuel mixture "M" into the scavenging passageways 31 and 32 from the crank chamber 18 is slightly delayed as compared with the case where the aforementioned portions 31*e* and 32*e* are not provided, it becomes possible to realize a more perfect lamellar scavenging.

As a result, it is now possible to perform a more perfect lamellar scavenging and to minimize the quantity of so-called blow-by, i.e. the quantity of air-fuel mixture to be discharged without being utilized for the combustion, thus making it possible to realize a reliable and perfect ignition of air-fuel mixture, to improve the fuel consumption, and to minimize the content of poisonous components in the exhaust gas.

Further, in addition to the aforementioned effects, the following merits can be achieved. Namely, according to the two-cycle internal combustion engine 1 of this embodiment, the air intake passageway 50 can be disposed inside the wall 10A of the cylinder 10, so that in contrast to the conventional internal combustion engine where bifurcated air inlet passageways are required to be separately installed outside the engine body (cylinder and crankcase), it becomes possible according to this embodiment to reasonably and compactly arrange the peripheral components of engine, thereby making it possible to reduce the number of parts, to lighten the weight thereof, to save the manufacturing cost thereof, and to simplify the working and assembling thereof.

In this case, when a pair of right and left branch passageways 52 constituting the main portion of the air intake passageway 50 are made linear, respectively, these branch passageways 52 can be produced not only by a punching process but also by drilling work, and at the same time, the scavenging passageways 31 and 32 can be molded with the outer sides thereof being left open and subsequently closed by making use of the cap member 60, thereby greatly enhancing the productivity thereof.

Further, when the air intake passageway 50 is disposed inside the wall 10A of the cylinder 10, the effective length of the air intake passageway 50 can be shortened as compared with that of the prior art, thereby making it possible to improve the response characteristics thereof.

Moreover, since the feeding of air is performed using not the external pump but a piston pumping, the entire structure of engine can be simplified and the manufacturing cost thereof can be cut down.

Next, another embodiment of the present invention will be explained with reference the drawings.

Figure 5:
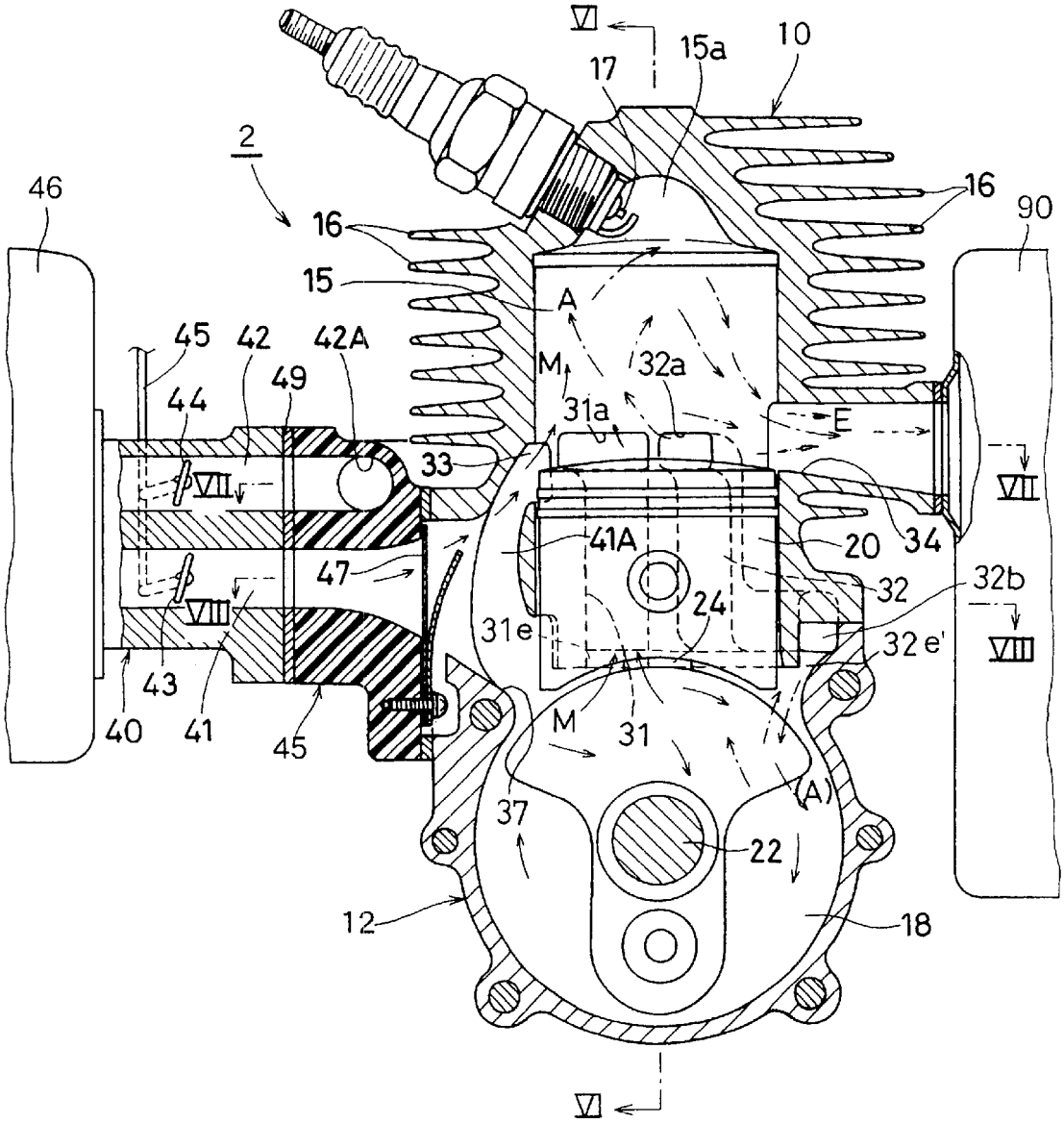
FIG. 5 is a longitudinal sectional view illustrating a second embodiment of a two-cycle internal combustion engine according to the present invention, wherein the piston is positioned at the bottom dead center.
Figure 6:
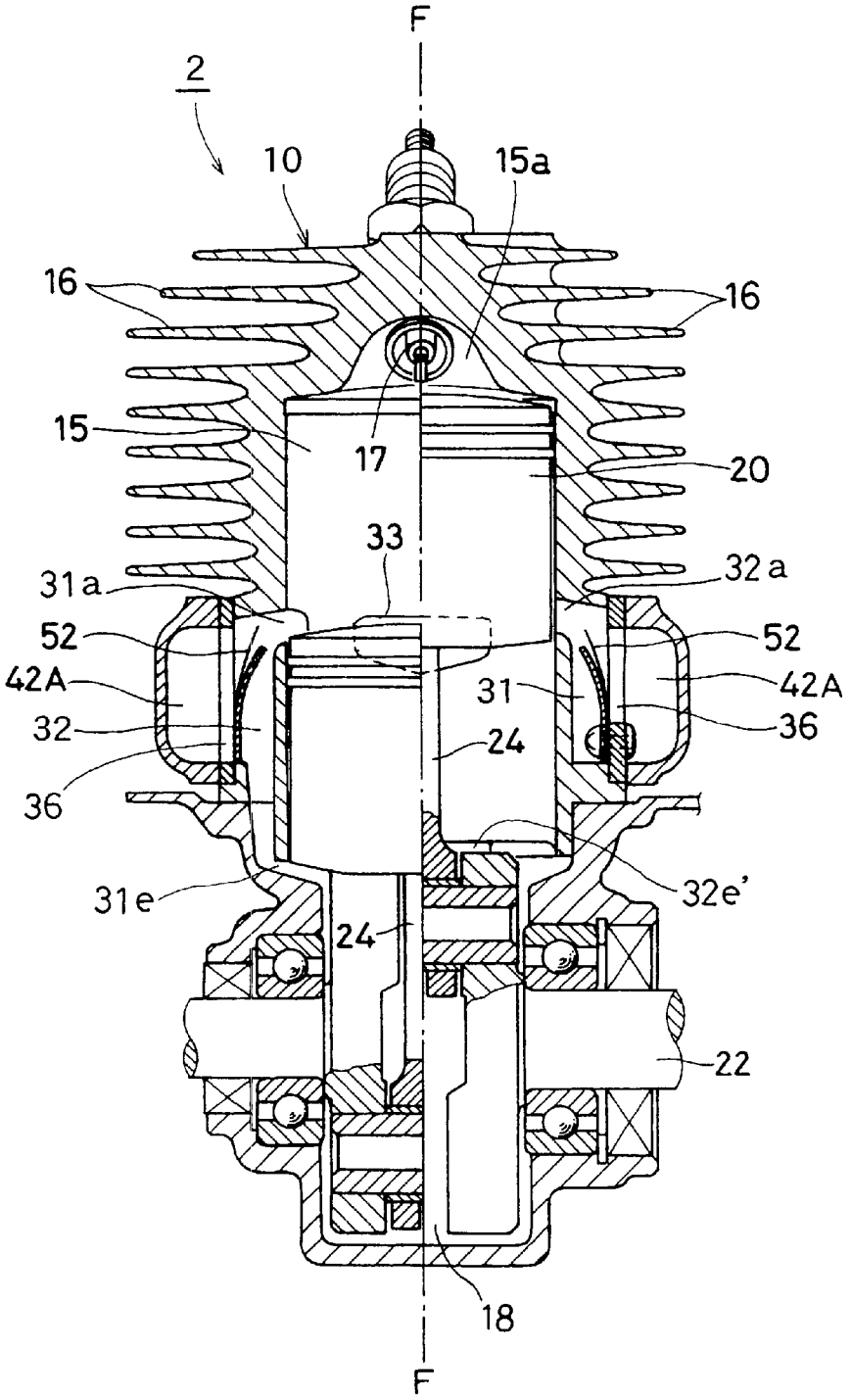
FIG. 6 is a cross-sectional view taken along the line VI—VI in FIG. 5.
Figure 7:
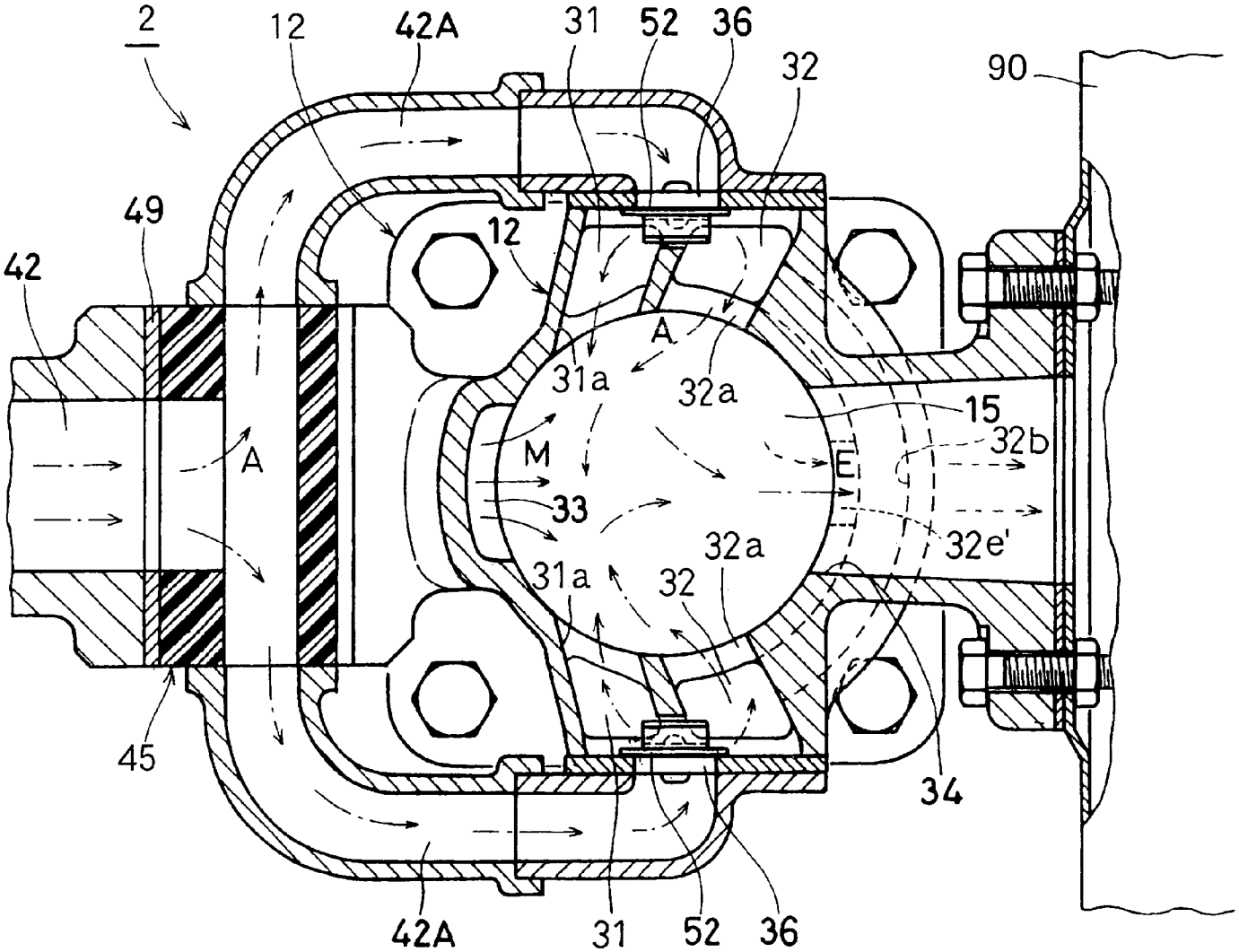
FIG. 7 is a cross-sectional view taken along the line VII—VII in FIG. 5.
Figure 8:
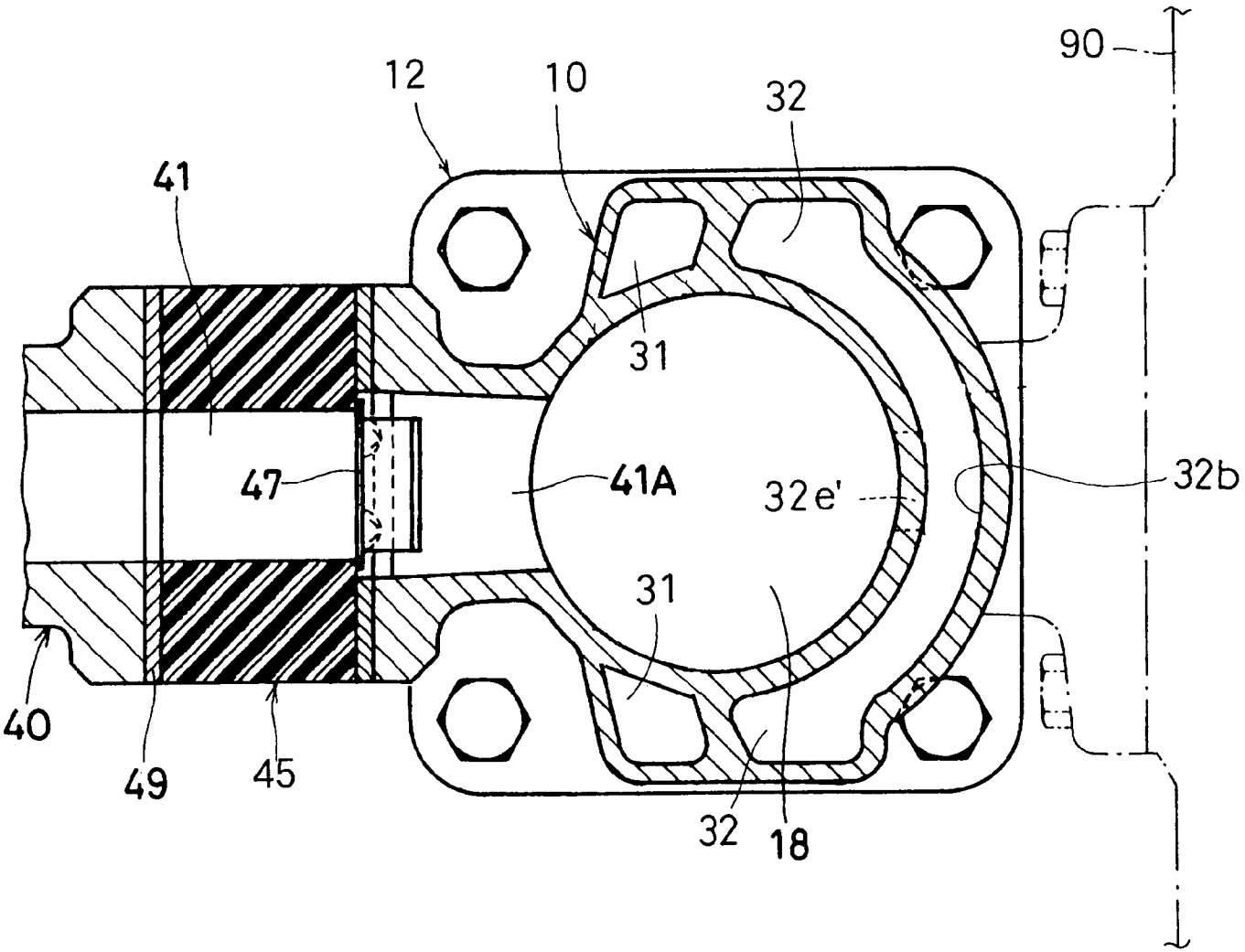
FIG. 8 is a cross-sectional view taken along the line VIII—VIII in FIG. 5.

FIG. 5 is a longitudinal sectional view illustrating a second embodiment of a two-cycle internal combustion engine according to the present invention; FIG. 6 is a cross-sectional view taken along the line VI—VI in FIG. 5; FIG. 7 is a cross-sectional view taken along the line VII—VII in FIG. 5; and FIG. 8 is a cross-sectional view taken along the line VIII—VIII in FIG. 5.

For the convenience of explanation, the left side of the line F—F in FIG. 2 illustrates a longitudinal sectional view sectioning a first scavenging port where the piston is positioned at the bottom dead center, while the right side thereof illustrates a longitudinal sectional view sectioning a second scavenging port where the piston is positioned at the top dead center.

In these FIGS., the same portions or the same functioning portions as those of the aforementioned first embodiment will be identified by the same reference symbols.

Referring to these FIGS., the two-cycle internal combustion engine 2 according to the second embodiment is formed of a small air-cooled two-cycle gasoline engine of quaternary scavenging type, which is adapted to be employed in a portable working machine. This engine 2 comprises a cylinder 10 in which a piston 20 is fittingly inserted, and a crankcase 12 axially supporting a crank shaft 22 which is designed to reciprocatively move the piston 20 up and down through a con'rod 24.

The cylinder 10 is provided, on the outer circumferential wall thereof, with a large number of cooling fins 16, and, at the head portion thereof, with a squish-dome shape (semi-spherical) combustion chamber 15*a* constituting the combustion actuating chamber 15. An ignition plug 17 is protruded into the combustion chamber 15*a*.

In order to enable the combustion actuating chamber 15 disposed over the piston 20 to communicate with a crank chamber 18, an exhaust port 34 is attached to one side (the right side in FIG. 5) of trunk portion of the cylinder 10. A pair of first scavenging passages 31 of Schnürle type (which are located on a side opposite to where the exhaust port 34 is disposed) and another pair of second scavenging passages 32 of Schnürle type (which are located on a side close to the exhaust port 34) are symmetrically provided on both sides of the longitudinal section F—F (FIG. 6) which imaginatively divides the exhaust port 34, in widthwise, into two equal parts. Further, a pair of first scavenging ports 31*a* which are opened to the combustion actuating chamber 15 are disposed at upper ends (downstream ends) of these first scavenging passages 31, respectively, and at the same time, a pair of second scavenging ports 32*a* which are opened to the combustion actuating chamber 15 are also disposed at upper ends (downstream ends) of the second scavenging passages 32, respectively.

In this embodiment, the top level of the first scavenging ports 31*a* is made identical with the top level of the second scavenging ports 32*a,* and these scavenging ports 32*a* are enabled to simultaneously open in the descending stroke of the piston 20.

A pair of first scavenging passages 31 and another pair of second scavenging passages 32 are constructed respectively as a walled scavenging passageway wherein the side thereof facing the combustion actuating chamber 15 is closed by the inner wall of the cylinder 10.

As seen from FIGS. 5, 6, 7 and 8, an intermediate portion of each of the second scavenging passages 32 is extended vertically along the longitudinal direction of the cylinder 10 and parallel with the first scavenging passages 31, while upstream portions 32*b* (the portions facing close to the crank chamber 18) of the second scavenging passages 32 are extended in the form of arch and in a plane orthogonally intersecting the aforementioned intermediate portion of the second scavenging passage so as to encircle the combustion actuating chamber 15, and the upstream ends thereof which are positioned close to one side of the exhaust port 34 where the crank chamber 18 is positioned are combined with each other, so that the entire length of the second scavenging passages 32 is elongated in this manner. The volume of the first scavenging passages 31 is made fairly larger than that of the second scavenging passages 32.

The second scavenging passages 32 are respectively provided, at the upstream end portion thereof which is positioned close to one side of the exhaust port 34 where the crank chamber 18 is positioned, with a common throttled portion 32*e′* for reducing the effective cross-sectional passage area as compared with that of the downstream portions of the second scavenging passages 32, so that the second scavenging passages 32 are communicated through this common throttled portion 32*e′* with the crank chamber 18.

Likewise, the first scavenging passages 31 are also provided, at the upstream end portion thereof which is positioned close to the exhaust port 34, with throttled portions 31*e′* for reducing the effective cross-sectional passage area as compared with that of the downstream portions of the first scavenging passages 31.

On one sidewall of the cylinder 10 which is opposite to where the exhaust port 34 is positioned (the left side in FIG. 5), there is disposed, via a passageway-attached heat insulator 45 and a packing 49, a carburetor 40 functioning as an air-fuel mixture-generating means. An air cleaner 46 is mounted on the upstream side of the carburetor 40.

The carburetor 40 is provided with an air feeding passageway (upstream portion) 42 for guiding the air "A" that has been cleaned by the air cleaner 46 to the first and second scavenging passageways 31 and 32, and with an air-fuel mixture feeding passageway (upstream portion) 41 for guiding air-fuel mixture "M" that has been produced in the carburetor 40 to the combustion actuating chamber 15. These air feeding passageway 42 and air-fuel mixture feeding passageway 41 are provided with throttle valves 44 and 43, respectively, which are designed to be interlocked with each other through a link member 45.

In this embodiment, these air feeding passageway 42 and air-fuel mixture feeding passageway 41 are arranged neighboring one over another, and as shown in FIGS. 6 and 7, the downstream portion of the air feeding passageway 42 is bifurcated into a couple of air intake passageways 42A. Air outlet ports 36 provided at the downstream ends of the air intake passageways 42A are intercommunicated with both of the first and second scavenging passageways 31 and 32. These air outlet ports 36 are provided with stopper-attached reed valves 52 each functioning as a check valve for preventing the air "A" from escaping toward the air intake passageways 42A during the descending stroke of the piston 20.

By the way, in this embodiment, only one check valve (the aforementioned reed valve 52) is employed for both of the first and second scavenging passageways 31 and 32 for the purpose of saving the cost. However, the check valve may be mounted separately for each of the first and second scavenging passageways 31 and 32.

The heat insulator 45 which is disposed on the downstream side of the air-fuel mixture feeding passageway 41 may be also provided with a stopper-attached reed valve 47 functioning as a check valve for preventing the air-fuel mixture "M" from counter-flowing toward the carburetor 40.

Additionally, an intercommunicating passageway 41A for communicating the crank chamber 18 with the combustion actuating chamber 15 is disposed at the downstream end of the air-fuel mixture feeding passageway 41. The downstream end (upper end) of the intercommunicating passageway 41A is formed into an air-fuel mixture supply port 33 which is opened to the combustion actuating chamber 15 disposed over the piston 20, so that the air-fuel mixture "M" is enabled to be ejected toward the combustion chamber 15*a* of the combustion actuating chamber 15 from the air-fuel mixture supply port 33 and from the first and second scavenging ports 31*a* and 32*a* which are provided at the downstream ends of the first and second scavenging passageways 31 and 32, respectively. Furthermore, by way of the air-fuel mixture feeding passageway 41 and the intercommunicating passageway 41A, the air-fuel mixture "M" is also enabled to be introduced via the crank chamber port 37 into the crank chamber 18.

According to the two-cycle internal combustion engine 2 of this embodiment which is constructed as described above, the external air "A" is sucked up and introduced into the first and second scavenging passages 31 and 32, and stored therein (a small quantity of the air "A" is also introduced into the crank chamber 18 through the throttled portions 31*e* and 32*e′*) On the other hand, the air-fuel mixture "M" supplied from the carburetor 40 is sucked up and introduced into the air-fuel passageway 41 and the crank chamber 18, allowing the air-fuel mixture to be stored therein. On this occasion, the first and second scavenging passages 31 and 32 are filled only with the air "A", and the air-fuel mixture "M" is prevented from entering into these scavenging passages 31 and 32.

When the air-fuel mixture "M" existing inside the combustion actuating chamber 15 disposed over the piston 20 is ignited and exploded, the piston 20 is pushed down due to a combustion gas. During this descending stroke of the piston 20, the air "A" and the air-fuel mixture "M" existing in the first and second scavenging passages 31 and 32, and in the crank chamber 18 are compressed by the piston 20, and at the same time, an exhaust port 34 is opened at first, and when the piston 20 is further descended, the first and second scavenging ports 31*a* and 32*a* provided at a downstream end of the first and second scavenging passageways 31 and 32 are concurrently opened. During the initial stage of this scavenging period wherein the scavenging ports 31*a* and 32*a* are opened, only the air "A" which has been existed in the first and second scavenging passageways 31 and 32 and compressed by the descending stroke of the piston 20 is permitted to be introduced in advance into the combustion actuating chamber 15 from the scavenging ports 31*a* and 32*a*.

When the piston 20 is further descended, the air "A" existing inside the second scavenging passageways 32 is continuously introduced (introduced throughout the entire scavenging period) into the combustion actuating chamber 15 from the second scavenging ports 32*a*. Whereas the introduction of air "A" from the scavenging ports 31*a* to the combustion actuating chamber 15 is completed. Namely, since the volume of the second scavenging passageways 32 is made larger than that of the first scavenging passageways 31, when a certain period of time is elapsed after the first scavenging ports 31*a* are initiated to open, all of the air existing inside the first scavenging passageways 31 is completely introduced into the combustion actuating chamber 15 from the first scavenging ports 31*a*. Therefore, upon finishing the introduction of this air, the air-fuel mixture "M" that has been precompressed in the crank chamber 18 is permitted, following the finishing of introduction of the air, to be introduced via the first and second scavenging passageways 31 into the combustion actuating chamber 15 until the scavenging period is completed.

Therefore, in the descending stroke of the piston, the air "A" is introduced in advance into the combustion actuating chamber 15 from the scavenging ports 31*a* prior to the introduction of air-fuel mixture "M" (indicated by a solid line in FIGS. 5 and 7), and at the same time, a large quantity of air "A" (indicated by a dot and dash line in FIGS. 5 and 7) is permitted to be introduced from the second scavenging ports 32*a* into the combustion actuating chamber 15 for a longer period of time as compared with that of the scavenging ports 31*a*.

When the piston 20 is further descended after the first and second scavenging ports 31*a* and 32*a* have been opened, in other words, when the air-fuel mixture supply port 33 is opened a little behind the opening time of the first and second scavenging ports 31*a* and 32*a* (in terms of the angle of crank, belated by about 10 degrees for instance), a relatively rich air-fuel mixture "M" (indicated by a solid line in FIGS. 5 and 7) existing inside the air-fuel mixture passageway 41 (and also inside the crank chamber 18) is ejected from the air-fuel mixture supply port 33 into the combustion chamber 15*a* of the combustion actuating chamber 15 until the scavenging period is finished, allowing the air-fuel mixture "M" to turn around the combustion chamber 15*a*.

In the case of the conventionally proposed two-cycle gasoline engine of quaternary scavenging type where the first scavenging port is employed exclusively for air, and the second scavenging port is employed exclusively for an air-fuel mixture (for example, Japanese Patent Application H11-134091), waste combustion gas tends to be left remain at the region close to an inner wall portion of the cylinder, which is located opposite to where the exhaust port is located. Whereas, according to the two-cycle gasoline engine of this embodiment, only air "A" is permitted to be introduced into the combustion actuating chamber 15 from both of the first and second scavenging ports 31*a* and 32*a* at the initial stage of the scavenging period, so that the waste combustion gas "E" (shown in a dotted arrow in FIGS. 5 and 7) is forced, by this action of air "A", to be pushed out of the exhaust port 34 and then, discharged via a muffler 90 into the external atmosphere without leaving a residue of waste combustion gas "E" not only in the combustion actuating chamber 15 but also in a portion near the inner wall of cylinder which is disposed opposite to the exhaust port 34.

In this case, a layer of the air "A" that has been introduced in advance from the scavenging ports 31*a* and 32*a* into the combustion actuating chamber 15 is formed at an interface between the waste combustion gas "E" and the air-fuel mixture "M" that has been introduced, subsequent to the air "A", from the scavenging ports 31*a* and 32*a* into the combustion actuating chamber 15. Due to the existence of this air layer, the air-fuel mixture "M" is effectively prevented from being mixed with the waste combustion gas "E", thereby realizing almost a complete lamella scavenging.

In particular, according to the two-cycle internal combustion engine 2 of this embodiment, the second scavenging ports 32*a* are substantially exclusively employed as an air passageway. Whereas, in the case of the first scavenging ports 31*a,* although they are employed at first as an air passageway, they are subsequently employed as an air-fuel passageway. At the same time, the air-fuel mixture supply port 33 is opened a little behind the opening time of the first and second scavenging ports 31*a* and 32*a*. During the scavenging period after a middle stage thereof, a relatively rich air-fuel mixture "M" is ejected from the first scavenging ports 31*a* and the air-fuel mixture supply port 33 into the combustion chamber 15*a* of the combustion actuating chamber 15. Additionally, this air-fuel mixture "M" ejected in this manner can be effectively prevented from being mixed with the waste combustion gas "E" and allowed to turn around the combustion chamber 15*a,* thereby realizing almost a complete lamella scavenging. As a result, the quantity of so-called blow-by or the quantity of air-fuel mixture to be discharged without being utilized for the combustion can be reduced to as minimum as possible, thus making it possible to reliably and completely ignite the air-fuel mixture "M", to improve the fuel consumption and to reduce the content of poisonous components in the exhaust gas.

In particular, according to the two-cycle internal combustion engine 2 of this second embodiment, since the throttled portions 31*e* and 32*e'* are provided at the end portion of the scavenging passageways 31 and 32 which is located close to the crank chamber 18 as in the case of the first embodiment, an air-fuel mixture "M" can be inhibited from being mixed with the air "A" that has been sucked in advance into the scavenging passageways 31 and 32. As a result, the pre-introduction of air "A" can be reliably performed, thereby making it possible to realize a more perfect lamellar scavenging.

Additionally, due to the provision of the throttled portions 31*e* and 32*e,* the air-fuel mixture "M" can be introduced into the scavenging passageways 31 and 32 from the crank chamber 18 only when the pressure inside the crank chamber 18 is increased to a certain magnitude. In other words, since the timing of introducing an air-fuel mixture "M" into the scavenging passageways 31 and 32 from the crank chamber 18 is slightly delayed as compared with the case where the aforementioned portions 31*e* and 32*e* are not provided, it becomes possible to realize a more perfect lamellar scavenging.

As a result, it is now possible to perform a more perfect lamellar scavenging and to minimize the quantity of so-called blow-by, i.e. the quantity of air-fuel mixture to be discharged without being utilized for the combustion, thus making it possible to realize a reliable and perfect ignition of air-fuel mixture, to improve the fuel consumption, and to minimize the content of poisonous components in the exhaust gas.

Furthermore, the air passageway 42 and the air-fuel mixture passageway 41 can be installed side by side, it becomes possible to reasonably and compactly arrange the peripheral components of engine, thereby making it possible to facilitate the mounting work thereof on a portable power working machine, etc.

Moreover, since the feeding of air is performed using not the external pump but a piston pumping, the entire structure of engine can be simplified and the manufacturing cost thereof can be cut down.

While in the foregoing one embodiment of the present invention has been explained in details for the purpose of illustration, it will be understood that the construction of the device can be varied without departing from the spirit and scope of the invention.

For example, in the foregoing embodiments, the first scavenging ports 31*a* are positioned at the same level as the second scavenging ports 32*a* to thereby enable them to open concurrently. However, the elevational position of the first scavenging ports 31*a* may not be the same as that of the second scavenging ports 32*a,* i.e. the elevational positions of these scavenging ports may be differentiated. In addition to the elevational positions thereof, other various features thereof such as the configuration, the area of opening, and the horizontal angle may be suitably modified as long as it is possible to realize a lamellar scavenging and to enhance the scavenging effect thereof against the residual waste combustion gas "E".

Additionally, the volume of the first and second scavenging passages 31 and 32, or the effective cross-sectional passage area of the throttled portions 31*e,* 32*e* and 32*e'* may be suitably selected by taking into consideration the aimed air-fuel ratio of the air-fuel mixture "M" to be supplied for combustion in the combustion actuating chamber 15.

As seen from the foregoing explanation, according to the present invention, since a throttled portion is provided at the end portion of the scavenging passageway located close to the crank chamber, an air-fuel mixture can be inhibited from being mixed with the air that has been sucked in advance into the scavenging passageway. As a result, it possible to realize a more perfect lamellar scavenging, and to minimize the quantity of so-called blow-by, i.e. the quantity of air-fuel mixture to be discharged without being utilized for the combustion, thus making it possible to improve the fuel consumption and the power, and to minimize the content of poisonous components in the exhaust gas.

What is claimed is:

1. A two-cycle internal combustion engine which is constructed such that one or more pairs of Schnürle type scavenging passageways, each allowing a combustion actuating chamber disposed above a piston placed in a cylinder to be communicated with a crank chamber, are symmetrically provided on both sides of a longitudinal section which imaginatively divides an exhaust port into two equal parts, thereby enabling air to be introduced into the scavenging passageways and also enabling air-fuel mixture to be introduced into the crank chamber; and that in the descending stroke of the piston, the exhaust port is opened at first, and then, the scavenging port which is disposed at a downstream end of the scavenging passageway is opened, thereby enabling air to be introduced via the scavenging passageway into the combustion actuating chamber prior to the introduction of air-fuel mixture into the combustion actuating chamber;

said internal combustion engine being characterized in that said one or more pairs of Schnürle type scavenging passageways are respectively provided, near the end portion thereof located close to the crank chamber, with a throttled portion.

2. The two-cycle internal combustion engine according to claim 1, wherein said paired scavenging passageways are combined with each other at the portion thereof located close to the crank chamber to thereby enlarge the volume thereof, and are communicated with the crank chamber via a common throttled portion.

3. The two-cycle internal combustion engine according to claim 1 or 2, wherein said scavenging passageways are provided respectively with an air inlet passageway for introducing air therein, and the air inlet passageway is provided with an air check valve.

4. A two-cycle internal combustion engine which is constructed such that one or more pairs of schnürle type scavenging passageways, each allowing a combustion actuating chamber disposed above a piston placed in a cylinder to be communicated with a crank chamber, are symmetrically provided on both sides of a longitudinal section which imaginatively divides an exhaust port into two equal parts, thereby enabling air to be introduced into the scavenging passageways and also enabling air-fuel mixture to be introduced into the crank chamber; and that in the descending stroke of the piston the exhaust port is opened at first, and then, the scavenging port which is disposed at a downstream end of the scavenging passageway is opened, thereby enabling air to be introduced via the scavenging passageway into the combustion actuating chamber prior to the introduction of air-fuel mixture into the combustion actuating chamber;

said internal combustion engine being characterized in that said one or more pairs of schnürle type scavenging passageways are respectively provided, near the end portion thereof located close to the crank chamber, with a throttled portion, wherein the volume of said scavenging passageways is set to such that it is equal to or slightly smaller than the quantity of air to be introduced in advance.

5. A two-cycle internal combustion engine which is constructed such that one or more pairs of schnürle type scavenging passageways, each allowing a combustion actuating chamber disposed above a piston placed in a cylinder to be communicated with a crank chamber, are symmetrically provided on both sides of a longitudinal section which imaginatively divides an exhaust port into two equal parts, thereby enabling air to be introduced into the scavenging passageways and also enabling air-fuel mixture to be introduced into the crank chamber; and that in the descending stroke of the piston the exhaust port is opened at first, and then, the scavenging port which is disposed at a downstream end of the scavenging passageway is opened, thereby enabling air to be introduced via the scavenging passageway into the combustion actuating chamber prior to the introduction of air-fuel mixture into the combustion actuating chamber;

said internal combustion engine being characterized in that said one or more pairs of schnürle type scavenging passageways are respectively provided, near the end portion thereof located close to the crank chamber, with a throttled portion, wherein an effective cross-sectional passage area of the throttled portion is set to such that a required quantity of air-fuel mixture can be fed to the combustion actuating chamber following the introduction of air thereto.

6. The two-cycle internal combustion engine according to claim 4, wherein said paired scavenging passageways are combined with each other at the portion thereof located close to the crank chamber to thereby enlarge the volume thereof, and are communicated with the crank chamber via a common throttled portion.

7. The two-cycle internal combustion engine according to claim 6, wherein said scavenging passageways are provided respectively with an air inlet passageway for introducing air therein, and the air inlet passageway is provided with an air check valve.

8. The two-cycle internal combustion engine according to claim 4, wherein said scavenging passageways are provided respectively with an air inlet passageway for introducing air therein, and the air inlet passageway is provided with an air check valve.

9. The two-cycle internal combustion engine according to claim 5, wherein said paired scavenging passageways are combined with each other at the portion thereof located close to the crank chamber to thereby enlarge the volume thereof, and are communicated with the crank chamber via a common throttled portion.

10. The two-cycle internal combustion engine according to claim 9, wherein said scavenging passageways are provided respectively with an air inlet passageway for introducing air therein, and the air inlet passageway is provided with an air check valve.

11. The two-cycle internal combustion engine according to claim 10, wherein the volume of said scavenging passageways is set to such that it is equal to or slightly smaller than the quantity of air to be introduced in advance.

12. The two-cycle internal combustion engine according to claim 9, wherein the volume of said scavenging passageways is set to such that it is equal to or slightly smaller than the quantity of air to be introduced in advance.

13. The two-cycle internal combustion engine according to claim 5, wherein said scavenging passageways are provided respectively with an air inlet passageway for introducing air therein, and the air inlet passageway is provided with an air check valve.

14. The two-cycle internal combustion engine according to claim 13, wherein the volume of said scavenging passageways is set to such that it is equal to or slightly smaller than the quantity of air to be introduced in advance.

15. The two-cycle internal combustion engine according to claim 5, wherein the volume of said scavenging passageways is set to such that it is equal to or slightly smaller than the quantity of air to be introduced in advance.

* * * * *